US005363742A

United States Patent [19]

Yuda

[11] Patent Number: 5,363,742

[45] Date of Patent: Nov. 15, 1994

[54] AIR OVER OIL INTENSIFIER

[76] Inventor: Lawrence F. Yuda, P.O. Box 499, Westminster, S.C. 29693

[21] Appl. No.: 192,789

[22] Filed: Feb. 7, 1994

Related U.S. Application Data

[63] Continuation of Ser. No. 37,003, Mar. 25, 1993.

[51] Int. Cl.[5] ..... F15B 21/04

[52] U.S. Cl. ..... 92/79; 92/164; 60/584

[58] Field of Search ..... 60/584, 453; 91/4 R; 92/79, 163, 164

[56] References Cited

U.S. PATENT DOCUMENTS

| | | | |
|---|---|---|---|
| 1,951,224 | 3/1934 | Von Oberstadt | 60/584 |
| 3,253,412 | 5/1966 | Torossian | 60/584 |
| 4,116,004 | 9/1978 | Geary | 60/584 |

*Primary Examiner*—Edward K. Look
*Assistant Examiner*—F. Daniel Lopez
*Attorney, Agent, or Firm*—Ralph Bailey

[57] ABSTRACT

An air over oil intensifier has an oil chamber having first and second ports (C) and (E), respectively, opening into a highest collection point of the cylindrical interior of the oil chamber defined by an upwardly and inwardly tapering surface (D) at a top of the cylinder in both a vertical and a horizontal position.

2 Claims, 2 Drawing Sheets

AIR OVER OIL INTENSIFIER

This application is a continuation of application Ser. No. 08/037,003, filed Mar. 25, 1993.

Background of the Invention

This invention relates to an improved oil chamber for use in an air over oil intensifier providing structure facilitating the bleeding off of any air accumulations in the oil chamber.

Air over oil intensifiers have long been used wherein the oil chambers are adapted to be utilized in either a vertical or in a horizontal position, but not both. Such oil chambers have a single port located either in the top or in the side, respectively, depending upon whether they are adapted to be used in a vertical position or in a horizontal position. Such air over oil intensifiers are used in closed systems, and because of the cylindrical configuration of the interior of the oil chamber, it is difficult to bleed air from the system whether the port be a vertical port or a horizontal port since it is difficult to concentrate the air at an uppermost port for bleeding off.

SUMMARY OF THE INVENTION

Accordingly, it is an important object of this invention to provide an air over oil intensifier utilizing a novel structure facilitating the bleeding off of air from oil chambers employed in such systems.

Another important object is the provision of air over oil intensifiers having ports in the faces of the oil chambers to accomodate vertical positioning of each of the intensifiers and to provide a port on a side of the cylindrical oil chambers to permit horizontal positioning of each of the intensifiers.

Another object of the invention is to facilitate the bleeding off of air from the oil chamber of an air over oil intensifier capable of being positioned in either a vertical or in a horizontal position by drawing off air from the highest point in the oil chamber regardless of position.

Another important object of the invention is the provision of an oil chamber for use in an air over oil intensifier having a first port in a face for vertical positioning and a second port in a side for horizontal positioning of the intensifier, wherein a tapered upper surface is provided defining the uppermost interior of the cylindrical portion of the oil chamber, wherein the surface tapers upwardly and inwardly toward a port centrally located in an upper end face of the cylinder, and wherein the side port opens into an uppermost portion of the upwardly tapered surface when the intensifier is positioned horizontally to facilitate the bleeding off of air.

Another important object of the invention is to facilitate the avoidance of improper and erratic operation of air over oil intensifiers resulting from the accumulation of air in the oil chamber.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
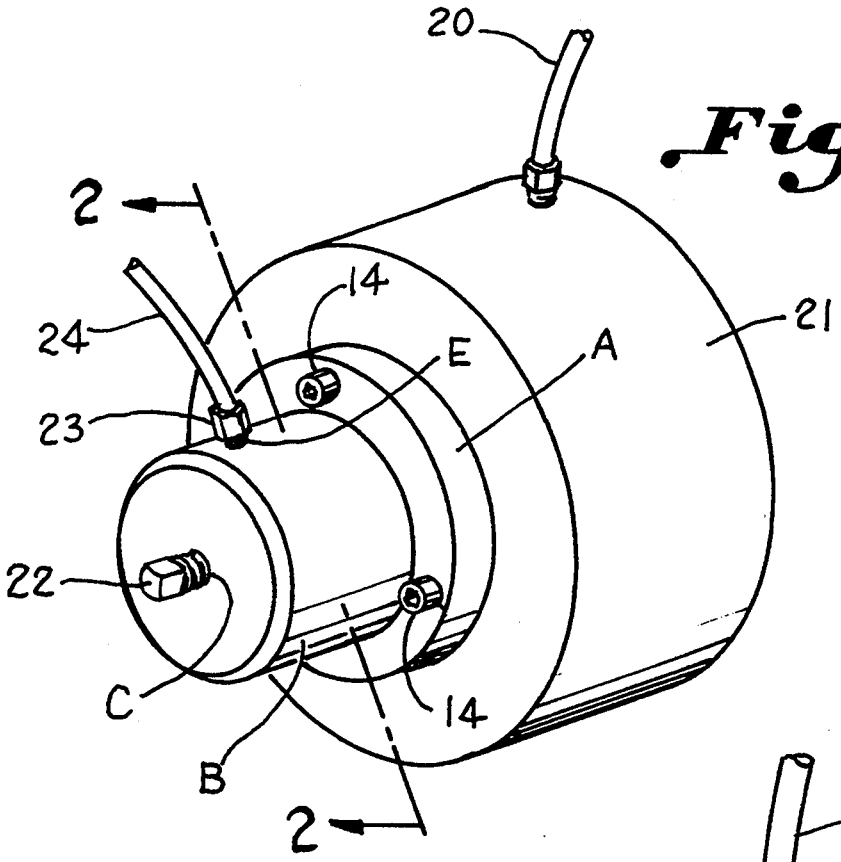
FIG. 1 is a perspective view illustrating an air over oil intensifier constructed in accordance with the present invention having a port in the face port of the oil chamber and a port in the side of the oil chamber.

The drawings illustrate an oil chamber for use in an air over oil intensifier including a base mounting member A having a flange with a central opening therein. A cylindrical housing B is carried by the base mounting having an open cylinder in axial alignment with and opening into the central opening. A first port C is provided in a central portion of a face at a head end of the housing opening into the open cylinder. An upwardly and inwardly tapering surface D in the head end converges into the first port. A second port E in a side portion of the housing between the face and the base mounting opens into the inwardly tapering surface. Thus, the first port serves to bleed air from the oil chamber when mounted in a vertical position, and the second port serves to bleed air from the oil chamber when mounted in a horizontal position. An enlarged air cylinder carries the base mounting member of the oil chamber in axial alignment and opens into the central opening in the base mounting member.

The oil chamber base mounting member A includes a cylindrical flange having a bore 10 therein defining a lower cylindrical interior portion of the oil chamber. The cylindrical interior is formed within a cylindrical housing B above which a frustoconical housing portion is formed by a first port C and an upwardly and inwardly tapering surface D. The first port C is defined in a face portion 11 of the oil chamber.

It will be observed that a second port E is formed in a side portion of the oil chamber which extends between the face 11 and the base mounting member A.

The cylindrical oil chamber has a flat surface 12 carried by a base portion of the flange. The central opening in the flange extends into the oil chamber cylinder. The flange A, forming the base mounting member, has suitable openings to receive a threaded shank 13 of a fastener which has a head 14.

Figure 2:
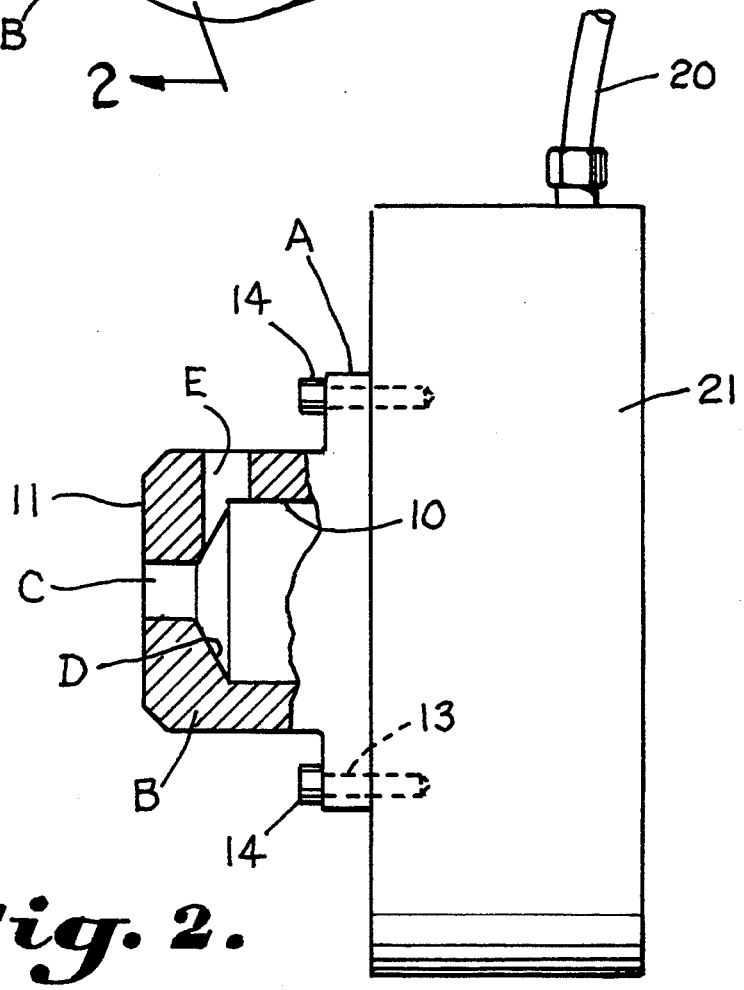
FIG. 2 is a side elevation with the oil chamber partially in-section along the line 2—2 in FIG. 1.

FIGS. 1 and 2 illustrate an air over oil intensifier wherein the oil chamber is illustrated in a horizontal position with the second port E being in operative position. A line for delivering factory air pressure is illustrated at 20 and this line enters a base portion of the air cylinder 21 below the piston. FIG. 1 illustrates the oil chamber as being in a horizontal position with the first port C being plugged by the member 22. The second port E has a suitable fitting 23 for attaching an oil line 24 which delivers oil at intensified or high pressure.

It will be observed in FIG. 2 that the second port E enters a portion of the volume generated by the upwardly and inwardly tapering surface D above the cylindrical walls 10 of the oil chamber. Thus, the line 24 may be opened in such a way as to bleed air within the oil chamber from a highest collection point of the cylindrical interior portion of the oil chamber.

Figure 3:
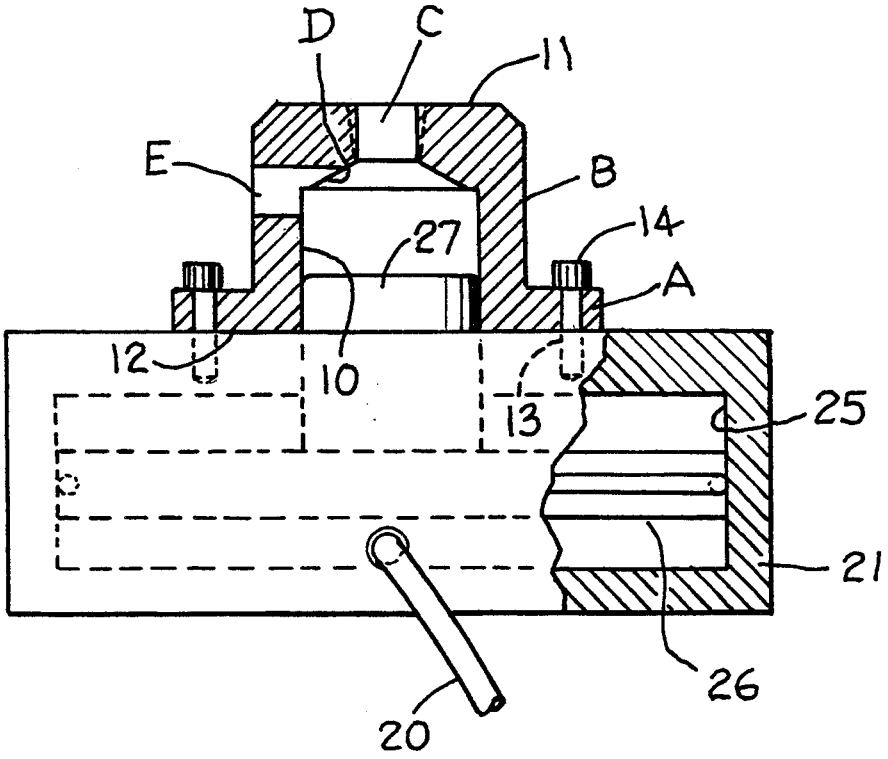
FIG. 3 is a side elevation illustrating the oil chamber and air cylinder in vertical position with the oil chamber in-section.

Referring now especially to FIG. 3, the oil chamber and associated air cylinder 21 are positioned in a vertical assembly. The line 20 enters the cylindrical interior 25 of the air chamber below the piston 26. The piston 26 has a cylindrical projection 27, which extends upwardly into the cylindrical interior 10 of the oil chamber, and acts as a piston intensifying the oil pressure. The port C is located in the face 11 and enters the cylinder at the apex of the surface generated by the upwardly and inwardly tapering surface D.

While a preferred embodiment of the invention has been described using specific terms, such description is for illustrative purposes only, and it is to be understood that changes and variations may be made without departing from the spirit or scope of the following claims.

What is claimed is:

1. An oil chamber for use in an air over oil intensifier comprising:

a base mounting member having a central opening therein;

a cylindrical housing carried by said base mounting member in axial alignment with said central opening;

an inner cylindrical wall in said housing on one side of said base mounting member generating a cylindrical interior volume;

a first port in a central portion of a face member at a head end of said housing opening into said cylindrical interior;

a piston within said cylindrical wall;

an inwardly tapering surface in said face member at said head end within said cylindrical housing opposite said piston converging into said first port generating a volume on one side of said cylindrical wall remote from said base mounting member facilitating the bleeding off of air when the cylindrical housing is in an upright position; and a second port in a side portion of said housing between said face member and said base mounting member opening into said volume generated by said inwardly tapering surface and into said cylindrical interior volume generated by said inner cylindrical wall for collecting air entrapped in said cylindrical housing at a juncture between said tapering surface and said second port when said cylindrical housing is in horizontal position and said second port is in an uppermost position;

whereby said first port serves to bleed air moved into said volume generated by said inwardly tapering surface responsive to movement of said piston toward said head end from said oil chamber when mounted in a vertical position, and said second port serves to bleed air from said oil chamber collected at said juncture responsive to said movement of said piston when mounted in a horizontal position, said first and second ports bleeding air from a highest collection point of said cylindrical housing both in a vertical position and in a horizontal position.

2. An air over oil intensifier comprising an oil chamber as set forth in claim 1 and further including an air cylinder larger than said base mounting member carrying said base mounting member in axial alignment and opening into said central opening in said base mounting member.

* * * * *